US008656854B2

(12) United States Patent
Rawson

(10) Patent No.: US 8,656,854 B2
(45) Date of Patent: Feb. 25, 2014

(54) KAYAK

(76) Inventor: Jeffery Rawson, Fairfield, CT (US)

( * ) Notice: Subject to any disclaimer, the term of this patent is extended or adjusted under 35 U.S.C. 154(b) by 1333 days.

(21) Appl. No.: 11/982,049

(22) Filed: Nov. 1, 2007

(65) Prior Publication Data

US 2008/0184925 A1 Aug. 7, 2008

Related U.S. Application Data

(63) Continuation-in-part of application No. 11/305,798, filed on Dec. 16, 2005, now abandoned.

(51) Int. Cl.
*B63B 35/00* (2006.01)
*B63B 35/71* (2006.01)

(52) U.S. Cl.
USPC ..... 114/347

(58) Field of Classification Search
USPC ..... 114/153, 343, 347, 363
See application file for complete search history.

(56) References Cited

U.S. PATENT DOCUMENTS 25,857 A * 10/1859 Wells ..... 114/59
4,389,958 A * 6/1983 March ..... 114/61.2
4,556,006 A * 12/1985 Kaupat ..... 114/162
4,660,490 A * 4/1987 Broadhurst ..... 114/61.26
5,042,416 A * 8/1991 Arcouette ..... 114/347
D322,744 S * 12/1991 Donalies ..... D8/333
D322,774 S * 12/1991 Arcouette ..... D12/302
5,127,862 A * 7/1992 Pia ..... 441/79
6,065,414 A * 5/2000 Hulbig et al. ..... 114/56.1
6,612,252 B2 * 9/2003 King et al. ..... 114/153
6,718,905 B1 * 4/2004 Peerson et al. ..... 114/347
6,736,084 B2 * 5/2004 Sheppard et al. ..... 114/363
7,198,529 B2 * 4/2007 Cleary ..... 440/21
2008/0098945 A1 * 5/2008 Weber ..... 114/347

OTHER PUBLICATIONS

Copy of pp. 16-17 of Ch. 1, Sect. 2 of vol. 1, SNAME Principles of Naval Architecture (c) Apr. 1988.*

* cited by examiner

*Primary Examiner* — Daniel Venne
(74) *Attorney, Agent, or Firm* — Patrick J. Walsh

(57) ABSTRACT

A kayak having a hull shape in which the wetted area is situated over the forward two-thirds section of the hull with the rear hull section having minimal wetted area to provide a kayak of increased steering leverage, and of exceptional maneuverability and speed. The hull has asymmetry that is defined by length-to-girth ratio.

28 Claims, 7 Drawing Sheets

KAYAK

This application is a continuation-in-part of copending application Ser. No. 11/305,798 filed Dec. 16, 2005 now abandoned.

BACKGROUND OF THE INVENTION

The present invention relates to boat hulls, and specifically to a new hull for kayaks.

A conventional kayak is generally symmetrical in hull form when viewed bow to cockpit and cockpit to stern and situates a cockpit in the center or slightly aft center of the craft, and centrally of port and starboard sides. Specifically, a conventional hull is generally symmetrical in keel line extending fore and aft when viewed in side elevation of the hull. When water borne, the kayak has a generally symmetrical waterline extending bow to stern. The wetted area of the hull as well as the shape of the hull (both fore to aft and port to starboard) is the same for the portion of the craft extending from bow to cockpit, as for the portion extending from cockpit to stern. The keel line at bow and stern is normally in the water when underway.

The result is a stable craft, centrally balanced from bow to stern with center of buoyancy at the cockpit, easily propelled by oar, and with the craft rotating about the cockpit in turning maneuvers and encountering water resistance over substantially the entire length of the hull. A paddler in the cockpit in turning the craft with an oar applies a turning moment to the entire wetted surface from stem to stern.

Conventional single occupant kayaks and similar watercraft are characterized in location of the cockpit in the middle section of the hull equidistant from bow and stern. For example, Broadhurst U.S. Pat. No. 4,660,490 discloses a watercraft comprising a hull construction useful for recreation and water sports and having a cockpit indentation located on the top part of the hull. The Broadhurst cockpit is located within the middle section of the hull within an area that is from about 25-30% of the length aft of the bow to about 60-65% of the length aft of the bow. Such middle section location of a cockpit is required in order to maintain proper level trim of the watercraft. Moreover, Broadhurst desires a keel line rise from middle section to bow of about 2 to 4 times the keel line rise from middle section to the stern. A middle section cockpit, then, is essential in realizing a keel line rise toward the bow as desired by Broadhurst. Moreover, the Broadhurst watercraft may have a fin positioned on the bottom part of the hull located from about 75 to 85% of the length of the hull aft of the bow. Accordingly the aft section of the hull must be in the water to utilize the fin, a condition assured by cockpit location in the middle section of the hull.

U.S. Pat. No. 6,612,252 to King and U.S. Pat. No. 6,736,084 to McDonough both disclose single occupant kayaks with cockpits in the middle section of the hull. U.S. Design Pat. No D332774 to Arcoutte is directed to both single and double occupant watercraft. In both single occupant and double occupant versions of Arcoutte, the cockpits are located centrally of a midpoint of the craft.

A conventional kayak then is a lightweight craft with symmetrical hull, cockpit located in the middle section of the hull, easy to propel manually, having water borne stability characterized by a wetted area extending bow to stern, and having a slow and predictable maneuvering capability.

The present invention provides a single occupant kayak characterized in being a stable craft, easily propelled by oar, and faster and highly maneuverable in comparison to conventional kayaks.

SUMMARY OF THE INVENTION

The present invention is directed to a highly maneuverable single occupant kayak formed of a hull having a cockpit situated forward of the hull mid-point between bow and stern, a hull section aft of the cockpit situated at or above the water line of the craft and having little or no wetted area, and a flat or generally horizontal keel plate extending from bow to stern. The keel plate extends along a keel line defined by convex curvature forward and concave curvature aft. The keel line convex-concave curvature is characteristic of the kayak according to the invention with an aft section at or above the water line.

A kayak according to the invention with a paddler aboard has a waterborne trim with bow out of the water, center of buoyancy at the cockpit, and with the aft section of the craft out of the water. The kayak is characterized in a fore-to-aft keel line having a forward convex curvature and an aft concave curvature. This keel line curvature has the effect of locating the water line forward and locating the rear portion of the kayak above the waterline to achieve high maneuverability of the craft.

The kayak according to the invention is also characterized in having an asymmetric hull as indicated by a length-to-girth fineness ratio constituting a parameter for defining transverse hull shape at stations aft of the bow. Length-to-girth ratio provides a metric for locating cockpit and center of buoyancy with reference to kayak length overall (LOA) and with respect to hull midpoint between bow and stern.

The kayak according to the invention has a substantially reduced wetted area as compared to conventional kayaks of the same length, enables a paddler to operate the kayak with greater leverage particularly in maneuvering the craft, and is characterized in being a faster and more highly maneuverable craft.

OBJECTS OF THE INVENTION

An object of the invention is to provide a new and improved single paddler kayak hull faster and more highly maneuverable than conventional craft.

Another object of the invention is to provide a kayak hull having a substantially smaller wetted area enabling a faster vessel of high maneuverability.

Another object of the invention is to provide a kayak with cockpit situated forward and a rear hull structure with minimal water resistance while underway.

Another object of the invention is to provide a kayak hull with flat keel plate between bow and stern to provide a high performance kayak.

Another object of the invention is to provide a kayak hull with curved keel line between bow and stern including convex curvature forward and concave curvature aft to provide a high performance kayak.

Another object of the invention is to provide a kayak having a hull shape in which the wetted area is situated over the forward two-thirds section of the hull with the rear hull section having minimal wetted area to provide a kayak of exceptional maneuverability and speed.

Another object of the invention is to provide a kayak in which the cockpit is located ahead of kayak midpoint and in which a rudder is positioned at the stern so as to provide high mechanical advantage between turning force applied by a paddler in the cockpit and the rudder for turning of kayak.

Another object of the invention is to define a kayak by length-to-girth ratio at stations along the length of the kayak, and to define location of the cockpit with reference to that ratio so as to make available the advantages of the kayak to those skilled in the art.

Another object of the invention is to provide a kayak having a fore-to-aft asymmetric hull with a length-to-girth ratio lowest forward of kayak longitudinal midpoint.

Another object of the invention is to provide a kayak having a fore-to-aft asymmetric hull with cockpit located where length-to-girth ratio is lowest among length-to-girth ratios for equidistant stations along the entire kayak length.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand the invention and is shown in the accompanying drawing in which.

DETAILED DESCRIPTION OF THE PREFERRED EMBODIMENT

Figure 1:
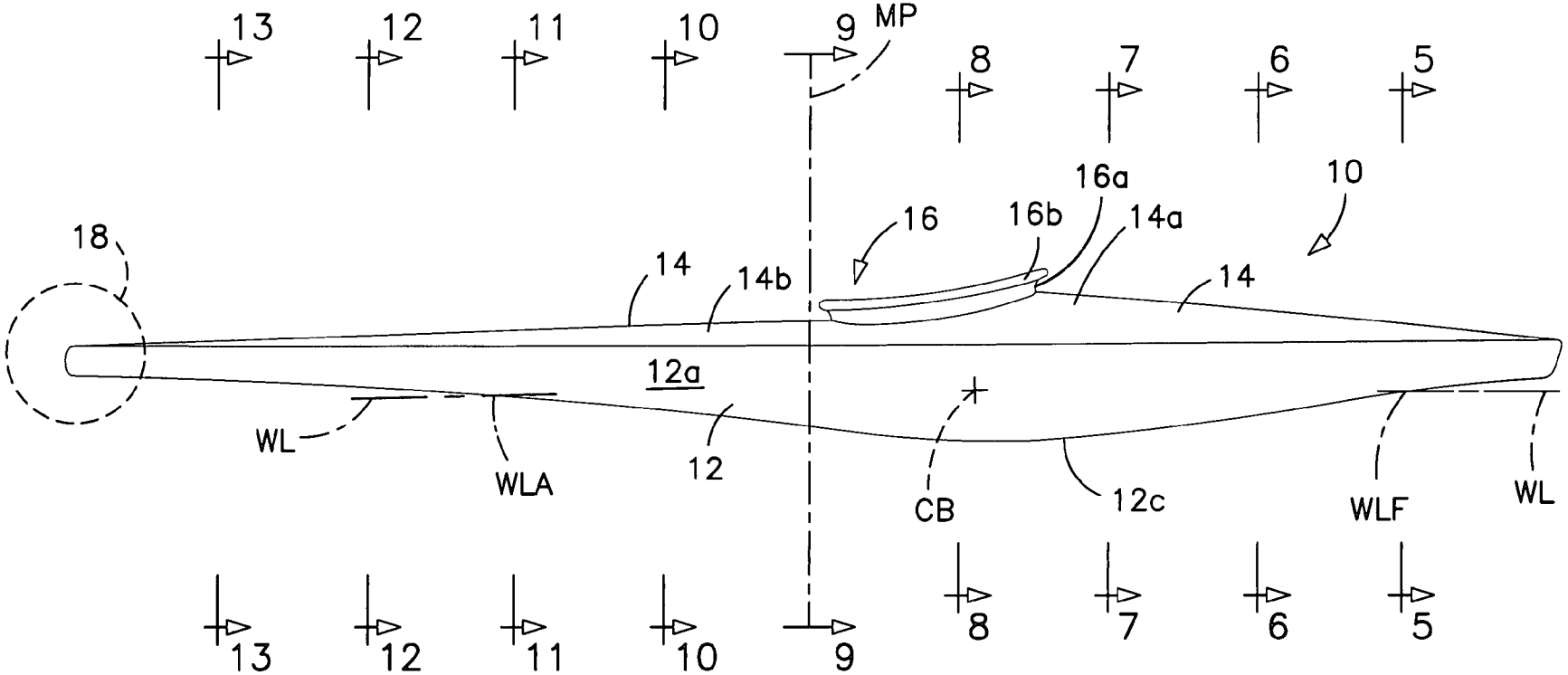
FIG. 1 is a side elevation a kayak according to the invention.
Figure 2:
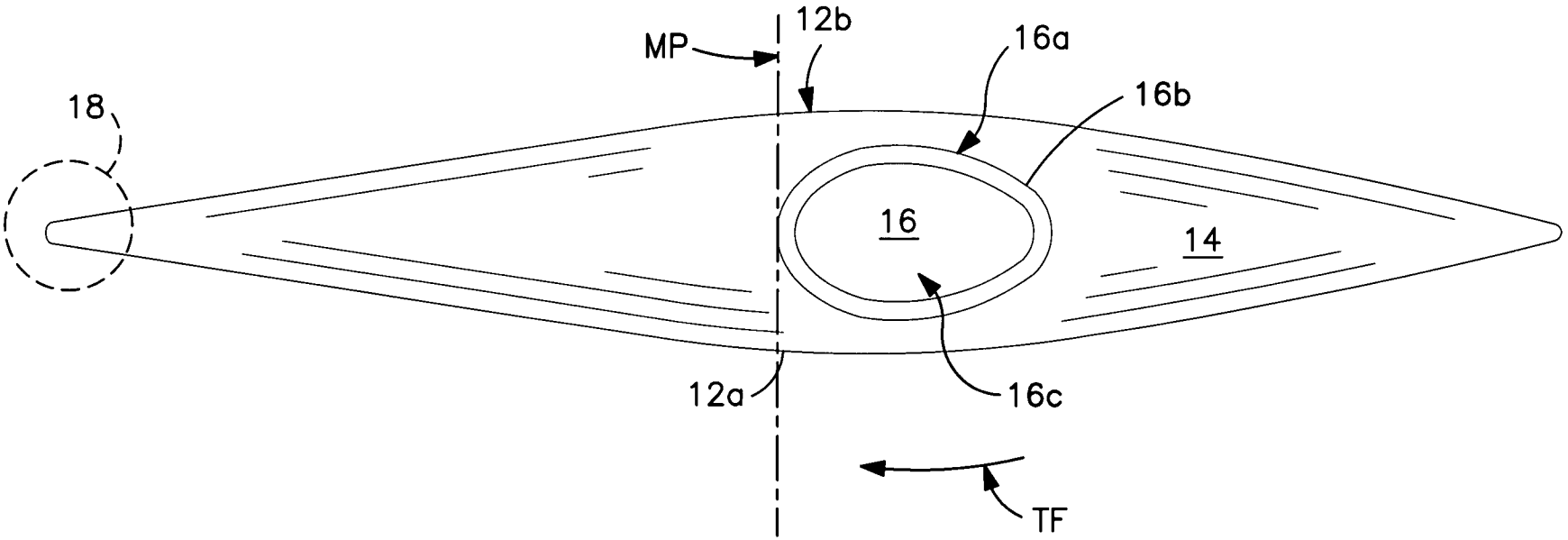
FIG. 2 is a plan view of the kayak of FIG. 1.
Figure 3:
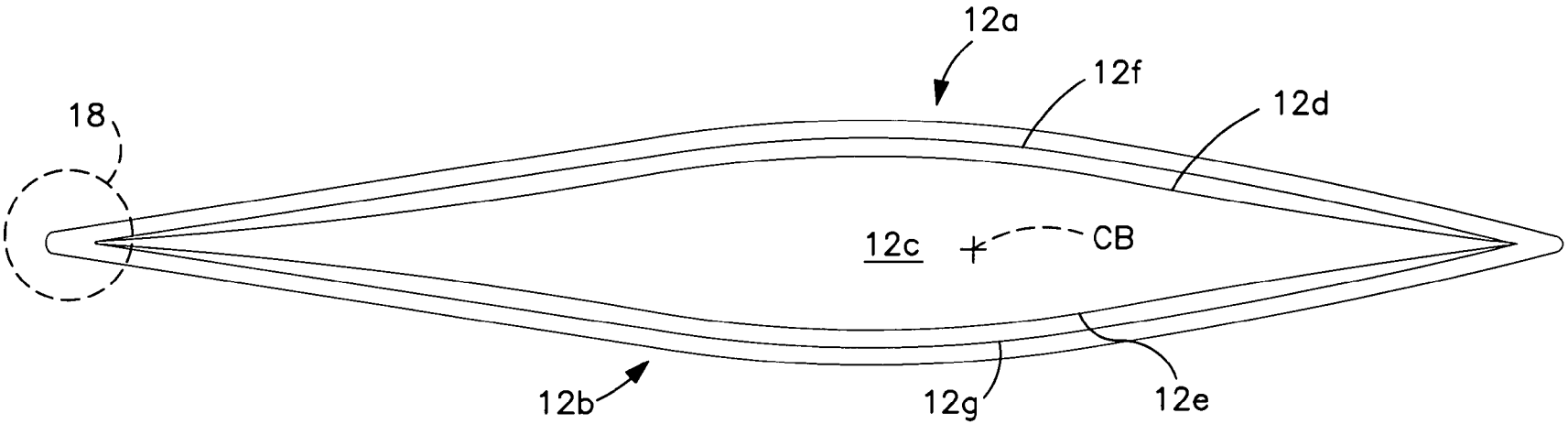
FIG. 3 is a bottom view of the kayak of FIG. 1.

Referring to drawing FIGS. 1-3 a kayak 10 according to the invention comprises hull 12, deck 14, cockpit 16 and steering gear 18.

The hull comprises an elongate watertight structure having starboard and port sides 12*a-b* and bottom 12*c* contours characterized in defining a wetted area of the hull over approximately the forward two-thirds portion of the hull. The water line WL (and wetted area) of the hull is indicated by dash line in FIG. 1 extending from a point WLF aft the bow to a point WLA aft the cockpit. The water line extends from forward point WLF located a distance from the bow of approximately one-tenth of the length-over-all (LOA) of the craft, to aft point WLA a distance from the bow in a range of approximately two-thirds to three-quarters of LOA of the craft.

When the kayak is water borne with a paddler aboard the center of buoyancy CB is well forward of the mid-point MP of the length-over-all of the craft and is located at the cockpit approximately amid forward two-thirds portion of the hull.

The aft one-quarter to one-third portion (from stern) of the hull is at or above the water line of the craft having little or no wetted area, and presents little or no turning resistance when a paddler maneuvers the kayak.

Figure 4:
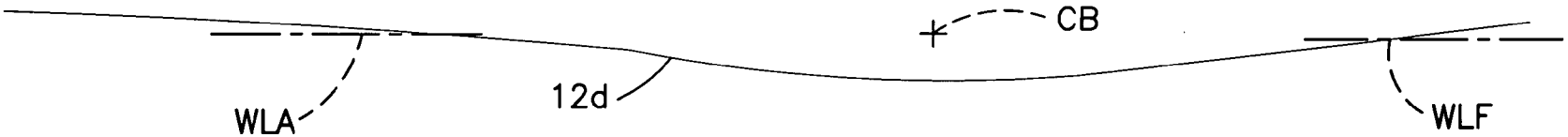
FIG. 4 shows the fore to aft curvilinear contour of the bottom plate of the kayak of FIG. 1.
Figure 10:
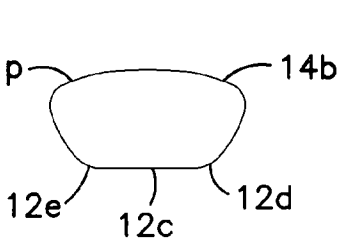
FIGS. 5-13 are section views of the kayak hull taken along lines 5-5 through 13-13 respectively of FIG. 1.
Figure 11:
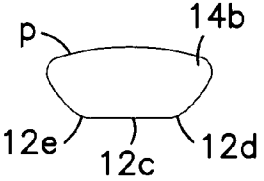
Figure 12:
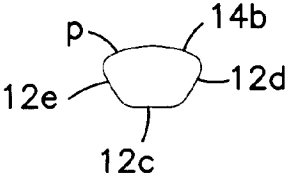
Figure 13:
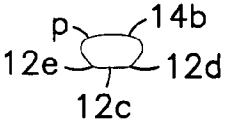

The bottom 12*c* or keel of the kayak is a transverse flat, elongate curvilinear plate extending from a point near the bow to a point near the stern. Section views FIGS. 5-13 show a flat transverse keel plate at each station where these views are taken. FIG. 4 shows the elongate curvilinear keel line 12*d* traced by the keel plate. As shown in FIGS. 1 and 4, the bottom plate extends in a curvilinear contour downwardly and aft from the bow reaching a low point adjacent the center of buoyancy and then gradually rising toward the stern. As the bottom plate rises and extends aft, it draws near to the water line such that aft section of the hull presents a diminishing wetted area. In a preferred embodiment of the invention as noted above, the section of the hull aft of the forward two-thirds portion of the hull has negligible wetted area. The keel line 12*d* comprises a complex curve of convex and concave portions. As a result the aft hull section encounters negligible water resistance. A flat bottom has the effect of lifting the craft and aiding maneuverability of the kayak in providing a lower turning resistance than encountered in a conventional transverse curved bottom of the craft.

Figure 16:
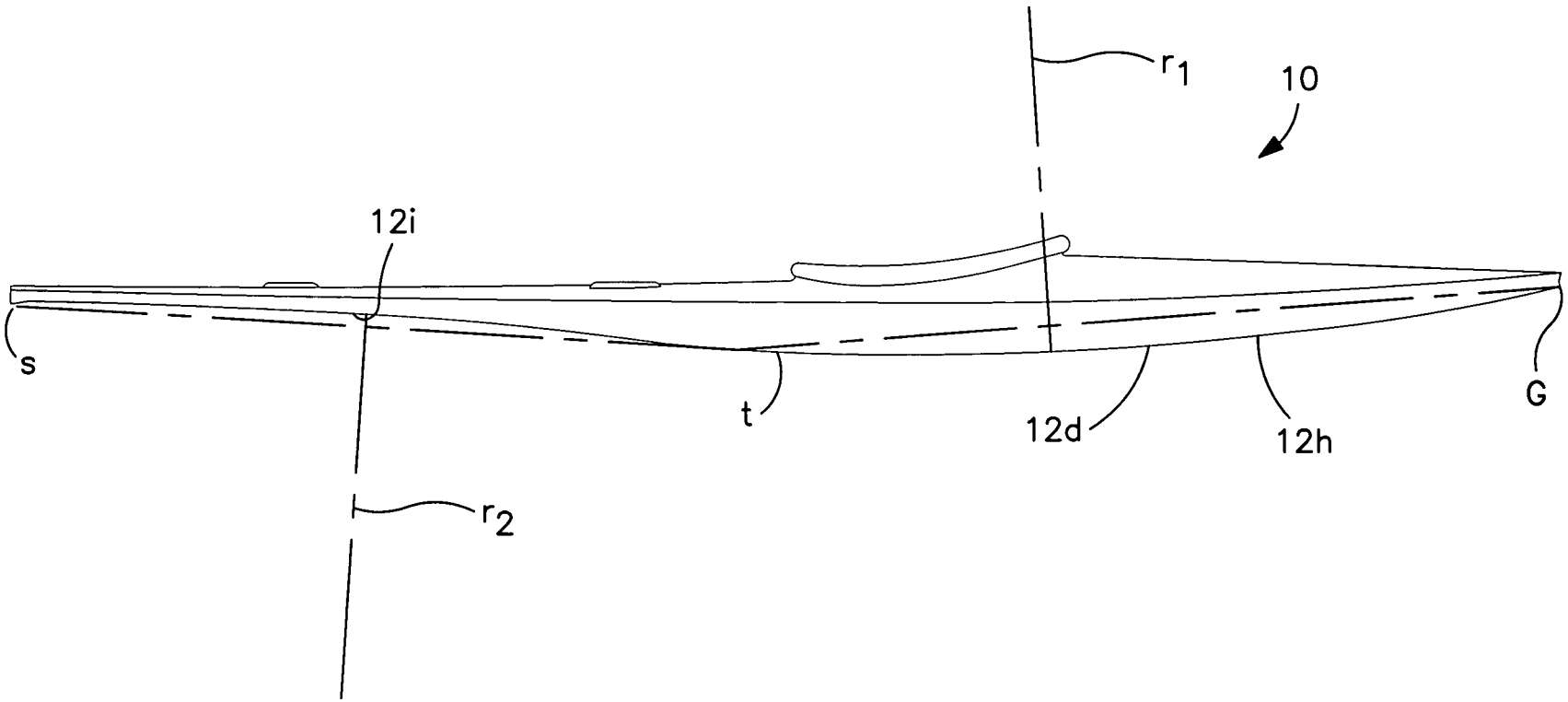
FIG. 16 is a side elevation view of a kayak according to the invention showing a keel line with convex curvature forward and concave curvature aft.

The keel line 12*d* is further defined with reference to FIG. 16 as comprising a forward convex curve section 12*h* and an aft concave curve section 12*i*. The location of convex 12*h* and concave 12*i* curves is determined as follows. A first line s-t extends between a point s at the juncture of stern and bottom plate to a point of tangency of the line s-t with keel line 12*d*. The tangent point is indicated by letter t. A second line b-t extends between a point b at the juncture of bow and bottom plate to the tangent point. Both lines s-t and b-t as well as kayak longitudinal axis x-x' (FIG. 18) lie in a vertical plane. It is to be observed from below the hull that the forward segment 12*h* of keel line is convex with respect to the line b-t and the aft segment 12*i* is concave with respect to the line s-t.

Tangent point t therefore defines a point of transition of the keel line from convexity to concavity. Keel transition from forward convex to aft concave curvature is an aspect of the present invention in achieving kayak maneuverability by bringing the aft section to a position at or above the water line while the forward convex curvature is waterborne for buoyancy of the kayak. The point of transition t is near the kayak midpoint, i.e., just aft the cockpit, as seen in FIGS. 1 and 16.

As best shown in FIGS. 1, 2, 17 and 18, the cockpit is situated ahead of the length-over-all midpoint MP (also designated as Station 5 in FIG. 1) of the kayak so that its burden when water borne is located at or near the center of buoyancy CB of the craft. In this location of the cockpit, the paddler is located centrally of the wetted area, i.e., that area of the hull below water line WL shown in FIG. 1.

The cockpit is fitted with an ovate cowling or spray skirt 16*a* having an upper flange 16*b* for receiving a waterproof shroud (not shown) normally used with kayaks. The cowling contour rises from rear to front to shed any water splashing over the deck forward of the cowling. The cockpit forms opening 16*c* (FIGS. 2, 8 and 18) through the deck accommodating a paddler in sitting position with legs extending forward in the usual manner for kayaks.

The deck 14 covers the hull in a watertight joint extending the full perimeter of the kayak. The transverse contour of the deck is shown section views FIGS. 5-13. The deck contour ahead of the cockpit is convex to aid in shedding water, and comparatively flat 14*b* aft the cockpit.

FIGS. 5-13 show pronounced chines 12*d* and 12*e* at the joints of bottom plate 12.*c* and starboard 12*a* and port 12*b* sides. In addition each of the starboard and port sides have pronounced chines 12*f* and 12*g* (FIG. 3) extending along the sides of the hull from bow to stern.

Figure 14:
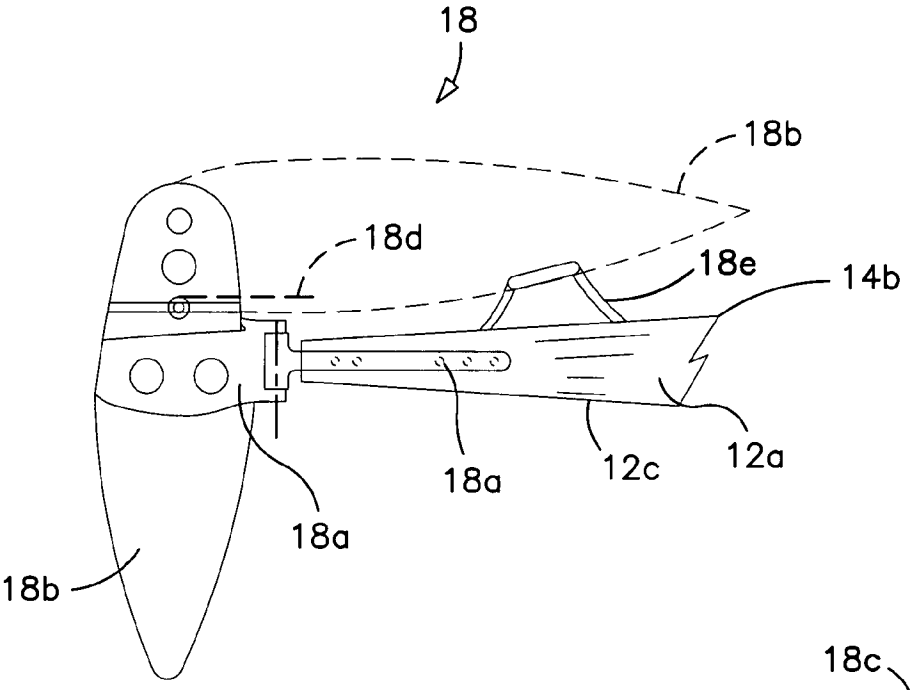
FIG. 14 is a fragmentary side elevation view showing a rudder mount for the kayak of FIG. 1.
Figure 15:
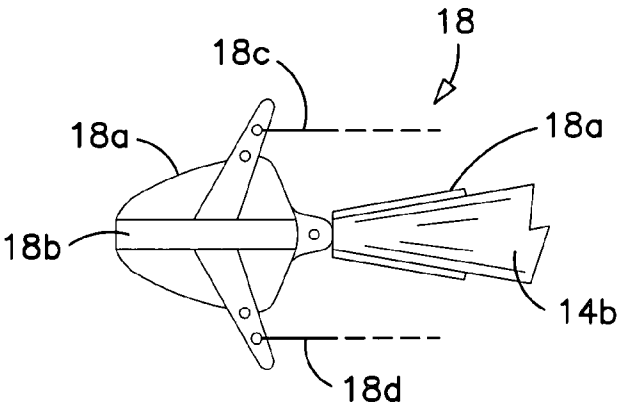
FIG. 15 is a plan view of the rudder mount of FIG. 14.

The stern of the kayak is fitted with steering gear 18 (FIGS. 14 and 15) conventionally used for such craft, including mounting hardware 18*a*, and rudder blade 18*b* operable by means of lines 18*c-d* extending to the cockpit and controlled by paddler's feet. The rudder may be moved to a stowage position when the kayak is removed from the water (dash lines in FIG. 14) and held by retaining bracket 18*e* fitted to the deck.

As shown in FIGS. 1, 2, 16 and 17, the cockpit is located ahead of the midpoint MP and near to the center of buoyancy CB which is located at a point distant from the bow equal to approximately 40% of LOA. The remaining distance (approx 60% LOA) between cockpit and rudder constitutes a moment arm providing high mechanical advantage for turning force (arrow TF, FIG. 2) applied by a paddler with oar in the cockpit and directed by the rudder 18*b* at the stern for turning the kayak. High maneuverability of the kayak results from the rear portion of the hull being at or above the water line, the wetted area being situated over the forward two-thirds of the hull, and the cockpit being forward of the kayak midpoint for high mechanical advantage of turning force applied there by the paddler.

Figure 9:
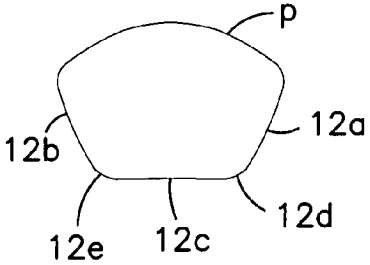
Figure 5:
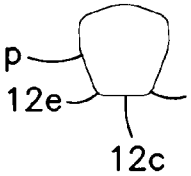
Figure 6:
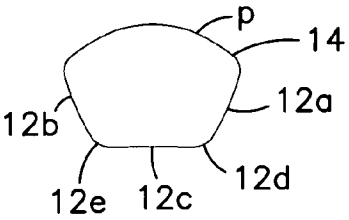
Figure 7:
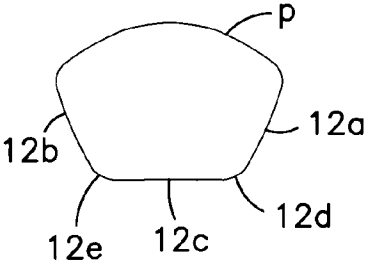

The kayak hull according to the invention is asymmetrical in that the hull form ahead of the midpoint is substantially different from the hull form aft of midpoint. This asymmetry is directly perceived by comparing FIG. 1 with FIGS. 5-13. FIG. 9 is a section view at midpoint, with FIGS. 8, 7, 6 and 5 showing hull forward sections and with FIGS. 10-13 showing hull aft sections. The perimeters p of hull forward sections are considerably larger than perimeters p of hull aft sections.

Figure 18:
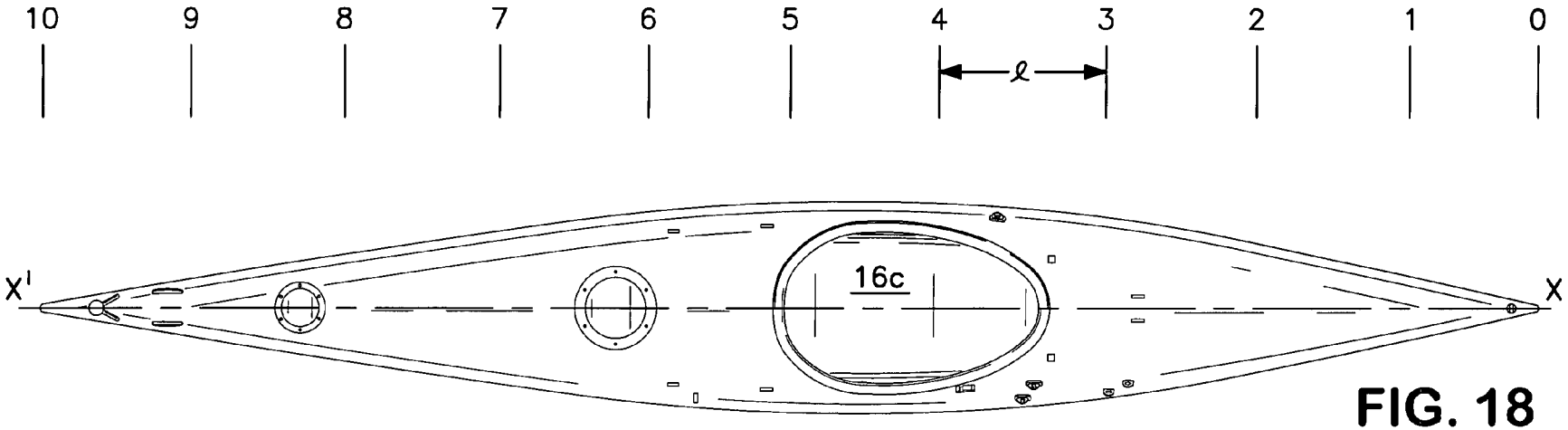
FIGS. 17 and 18 are side elevation and plan views respectively of the kayak of FIGS. 1-16 with eleven equidistant stations marked 0-10 along kayak length from bow to stern for determining length-to-girth ratio at each station.
Figure 17:
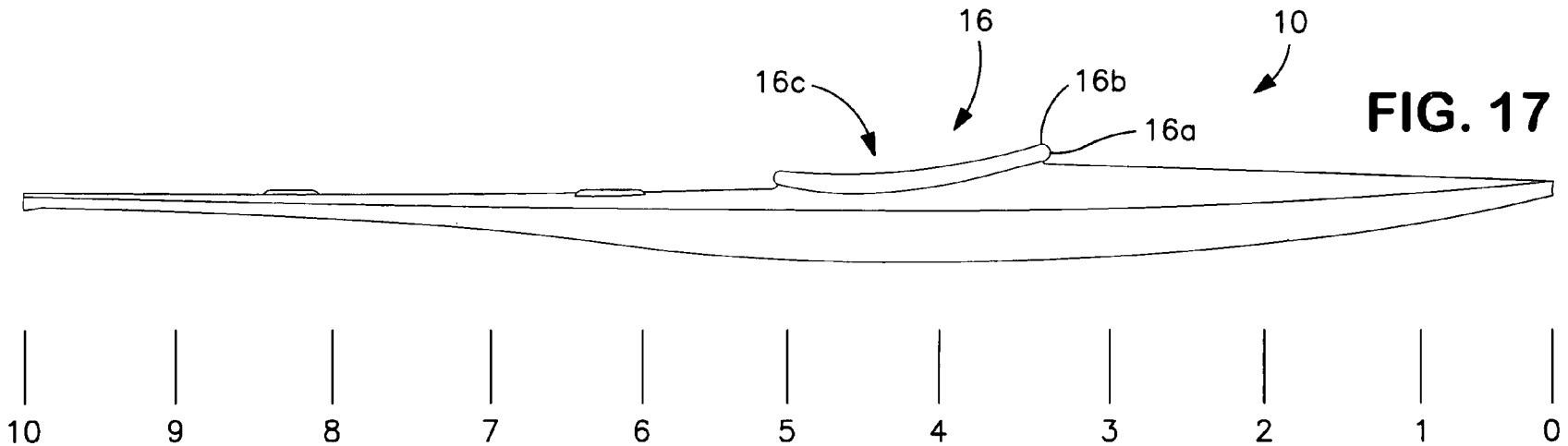

More specifically, hull asymmetry is defined by means of a length:girth (l/g) ratio for each of Stations 0-10 of FIGS. 17 and 18. An l/g ratio is length over all of a kayak divided by perimeter or girth at each station. L/g ratio provides a defining parameter for indicating fineness of hull sections fore and aft, for location of the cockpit, for location of the center of buoyancy, and for location of the cockpit in relation to the center of buoyancy. For ease of reference with respect to a plurality of l/g ratios, the hull may be described as asymmetric comprising a hull shape forward of the midpoint defined by a first length-to-girth ratio set, i.e., l/g ratios for Stations 0-5, and another hull shape aft of the kayak midpoint defined by a second length-to-girth ratio set, i.e., l/g ratios for Stations 5-10.

Figure 8:
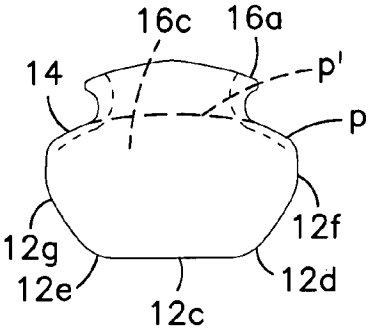

Girth measurements are taken transversely of the outer surface of the kayak along the perimeter p (FIGS. 5-13) of a plane normal to longitudinal axis x-x' (FIG. 18) of the kayak. Adjustment is made at Station 4 to factor out the effect of the cockpit cowling. The resultant Station 4 measurement is along perimeter p and along dash line p' (FIG. 8).

L/g ratios for adjacent stations, e.g., Stas. 3, 4 and 5 are an index of the volume of the hull at such stations, and are useful in comparing hull volume in respect of other stations, e.g., adjacent stations 6, 7, and 8. In an asymmetric hull, l/g ratios therefore designate and distinguish that section of the hull where the cockpit is located from other sections of the hull.

FIGS. 1, 17 and 18 respectively are side elevation and plan views of a kayak according to the invention. FIGS. 17 and 18 are marked with transverse stations 0-10 equally spaced along the length of the kayak with Station 5 being kayak midpoint MP. As is clear from FIG. 1, Stations 1-9 correspond to section views of FIGS. 5-13. It is to be observed that the cockpit is situated through the deck ahead of Station 5 and between Stations 3 and 5. It is also to be observed that the center of buoyancy is at Sta. 4.

The overall length (l) of a kayak and the girth (g) at each station are measured for computing an l/g ratio for each station. The kayak measured 15 feet, 8 inches LOA and has substantially the following l/g ratios.

l/g Table N° 1

| Station | l/g ratio |
|---|---|
| 0 | 28.9 |
| 1 | 7.5 |
| 2 | 4.4 |
| 3 | 3.4 |
| 4 | 3.1 |
| 5 | 3.2 |
| 6 | 3.6 |
| 7 | 4.4 |
| 8 | 6.3 |
| 9 | 11.8 |
| 10 | 26.3 |

The bow section of the kayak may be said to be the forward 20% of the craft (Sta. 0-2); the midsection the next 40% aft the bow section (Sta. 3-6); and the stern section the remaining 40% of the craft (Sta. 7-10). In like manner, the bow section has an l/g range of 28.9 to 4.4; the mid section an l/g range of 3.4 to 3.6; and the stern section an l/g range of 4.4 to 26.3. It will be understood that lower l/g ratios of the midsection correspond to the center of buoyancy of the kayak being located at the cockpit (i.e., Station 4), and being forward of the longitudinal mid-point (i.e., Station 5) of the kayak. The cockpit is located between Stations 3 and 5 where l/g is 3.4 (Sta. 3), 3.1 (Sta. 4), and 3.2 (Sta. 5). In accordance with the invention, therefore, the cockpit lies ahead of the kayak mid-point, lies in a zone (Stations 3-5) with an l/g ratio in a range from about 3.1 to 3.4, and lies at the center of buoyancy of the kayak. When the l/g ratio at each Station of the kayak is considered, it is observed that the cockpit is situated among Stations having the lowest l/g ratios. It is also to be observed that the lowest l/g ratio occurs at Station 4 at the center of buoyancy. (See FIG. 1).

The l/g ratio range for the aft section rises rapidly corresponding to the increasing fineness of hull lines approaching the stern clearly apparent in FIG. 17, and in FIGS. 1 and 9-13.

A kayak according to the invention may be further defined by l/g ratios as comprising a bow section with an l/g ratio of 4.4 to 28.3; a cockpit section with an l/g ratio of 3.1 to 3.4; and an aft section with an l/g ratio from about 3.6 to 26. It is to be further noted that the aft portion of the kayak situated at or above the water line, i.e., Stations 7-10, has an l/g ratio of 4.4 to about 26.3.

In another embodiment, a kayak with a LOA of 18.5 feet has substantially the following l/g ratios taken at Stations as designated in FIGS. 1, 17 and 18:

l/g Table N° 2

| Station | l/g ratio |
|---|---|
| 0 | 31.7 |
| 1 | 8.5 |
| 2 | 5.0 |
| 3 | 3.8 |
| 4 | 3.6 |
| 5 | 3.7 |
| 6 | 4.2 |
| 7 | 5.1 |
| 8 | 7.2 |
| 9 | 13.5 |
| 10 | 44.4 |

In this embodiment, the cockpit is situated in that section of the kayak where l/g ratio is less than 4, and where the Stations of the kayak ahead and aft of the cockpit have l/g ratios greater than 4.

In this embodiment, the bow section has an l/g range of 31.7 to 5.0; the mid section an l/g range of 3.8 to 4.2; and the stern section an l/g range of 5.1 to 44.4. It will be understood that lower l/g ratios of the midsection correspond to the center of buoyancy of the kayak being located at the cockpit (i.e., Station 4), and being forward of the longitudinal mid-point (i.e., Station 5) of the kayak. The cockpit is located between Stations 3 and 5 where l/g is 3.8 (Sta. 3), 3.6 (Sta. 4), and 3.7 (Sta. 5). In accordance with the invention, therefore, the cockpit lies ahead of the kayak mid-point, lies in a zone (Stations 3-5) with an l/g ratio in a range from about 3.6 to 3.8, and lies at the center of buoyancy of the kayak. When the l/g ratio at each Station of the kayak is considered, it is observed that the cockpit is situated among Stations having the lowest l/g ratios. It is also to be observed that the lowest l/g ratio occurs at Station 4 adjacent the center of buoyancy. (See FIG. 1).

The l/g ratio range for the aft section rises rapidly corresponding to the increasing fineness of hull lines approaching the stern clearly apparent in FIG. 17, and in FIGS. 1 and 9-13.

A kayak according to the invention may be further defined by l/g ratios as comprising a bow section with an l/g ratio of 5.0 to 31.7; a cockpit section with an l/g ratio of 3.6 to 3.8; and an aft section with an l/g ratio from about 4.2 to 44.4. It is to be further noted that the aft portion of the kayak situated at or above the water line, i.e., Stations 7-10, has an l/g ratio of 5.1 to about 44.4.

In still another embodiment, a kayak with a LOA of 11.0 feet has substantially the following l/g ratios taken at Stations as designated in FIGS. 1, 17 and 18:

l/g Table N° 3

| Station | l/g ratio |
|---|---|
| 0 | 17.6 |
| 1 | 5.6 |
| 2 | 3.3 |
| 3 | 2.4 |
| 4 | 2.1 |
| 5 | 2.1 |
| 6 | 2.5 |
| 7 | 2.7 |
| 8 | 3.9 |
| 9 | 7.0 |
| 10 | 18.9 |

In this embodiment, the cockpit is situated in that section of the kayak where l/g ratio is 2.4 or less, whereas the Stations of the kayak ahead and aft of the cockpit have l/g ratios greater than 2.4.

In this embodiment, the bow section has an l/g range of 17.6 to 3.3; the mid section an l/g range of 2.1 to 2.4; and the stern section an l/g range of 2.5 to 18.9. It will be understood that lower l/g ratios of the midsection correspond to the center of buoyancy of the kayak being located at the cockpit (i.e., Station 4), and being forward of the longitudinal mid-point (i.e., Station 5) of the kayak. The cockpit is located between Stations 3 and 5 where l/g is 2.4 (Sta. 3), 2.1 (Sta. 4), and 2.1 (Sta. 5). In accordance with the invention, therefore, the cockpit lies ahead of the kayak mid-point, lies in a zone (Stations 3-5) with an l/g ratio in a range from about 2.1 to 2.4, and lies at the center of buoyancy of the kayak. When the l/g ratio at each Station of the kayak is considered, it is observed that the cockpit is situated among Stations having the lowest l/g ratios. It is also to be observed that the lowest l/g ratio occurs at Station 4 at the center of buoyancy (See FIG. 1). It is to be understood that to say that the lowest l/g ratio is at, near, or adjacent the center of buoyancy, and to say that the center of buoyancy is at, near or adjacent a station means a location within twenty percent of station length, i.e., longitudinal length 1 (FIG. 18) between consecutive stations.

The l/g ratio range for the aft section rises rapidly corresponding to the increasing fineness of hull lines approaching the stern clearly apparent in FIG. 17, and in FIGS. 1 and 9-13.

A kayak according to the invention may be further defined by l/g ratios as comprising a bow section with an l/g ratio of 3.3 to 17.6; a cockpit section with an l/g ratio of 2.3 to 2.4; and an aft section with an l/g ratio from about 2.5 to 18.9. It is to be further noted that the aft portion of the kayak situated at or above the water line, i.e., Stations 7-10, has an l/g ratio of 2.7 to about 18.9.

In each of the foregoing embodiments, l/g ratios are stated as substantially the values given in Table Nos. 1-3. The term substantially for purposes of this application means plus or minus 10% of the values stated.

The forward convex curve **12*h* (FIG. 16) of keel line has a radius $r_1$ in a range of 1.4 to 1.8, and is preferably 1.6, times the length overall of the kayak. The rear concave curve 12*i*** of keel line has a radius $r_2$ in a range of 2.7 to 3.3, and is preferably 3.0, times the length overall of the kayak.

In use, the kayak is propelled by oar in the hands of a paddler positioned forward of the midpoint of the kayak at the center of buoyancy of the kayak and amid the wetted area of the craft. For a turning maneuver a paddler propelling the craft applies a turning force in the vicinity of the cockpit and center of buoyancy, with turning resistance confined to the wetted area such that the craft turns rapidly and with a shorter turning radius in comparison to a conventional kayak. Increased steering leverage is attained in locating mass (i.e., the paddler and forward hull) forward in the craft at an increased distance from the rudder. With the paddler applying a turning moment at Station 4, the remaining 60% of the kayak length aft of Station 4 provides a highly effective and highly levered moment arm applied to the rudder for turning the kayak. In addition, by reason of the flat keel plate and convex/concave keel line the kayak has lower wetted area than a conventional kayak and less water resistance to forward propulsion as well as turning motion of the craft. The result is a nimble kayak that is faster and more highly maneuverable with increased steering leverage as compared to conventional craft.

The invention in one embodiment provides a kayak with wetted area extending over the forward two-thirds of the hull. Advantages of the invention may be attained in a kayak with a wetted area extending over a range of forward ninety percent to fifty percent of the hull, with a preferred range of sixty to seventy-five percent of the hull.

Various changes may be made to the structure embodying the principles of the invention. The foregoing embodiments are set forth in an illustrative and not in a limiting sense. The scope of the invention is defined by the claims appended hereto.

I claim:

1. A kayak of predetermined length comprising a hull, deck, cockpit, the hull having port and starboard sides, a bow and stern, and steering gear including a rudder positioned at the stern, the hull having a wetted area extending through the forward two-thirds of the length of the kayak, a flat bottom plate extending from the bow in a curvilinear contour gradually rising toward the stern so as to be at or above the wetted area of the hull for the rear one-third of the length of the kayak, the deck affixed to the hull to form an enclosed watertight craft, the cockpit forming an opening through the deck and defining a station for a paddler to propel and to apply turning moment to the kayak with an oar, the cockpit situated forward of the longitudinal midpoint of the kayak so that the kayak burden is amid the wetted area of the hull and the hull having a moment arm for turning the kayak defined as the distance between the rudder and the cockpit where a paddler applies turning moment whereby the kayak encounters lower water resistance and high mechanical advantage when maneuvering as compared to a conventional kayak.

2. A kayak as defined in claim 1 wherein said distance is greater than one-half the length overall of the kayak.

3. A kayak as defined in claim 1 wherein said distance is approximately 60% of the length overall of the kayak.

4. A kayak of predetermined length-over-all and longitudinal midpoint comprising a hull, deck, cockpit and steering gear, the hull having port and starboard sides, a bow and stern, a flat bottom plate extending from the bow in a curvilinear contour gradually rising toward the stern, the deck affixed to the hull to form an enclosed watertight craft, the cockpit forming an opening through the deck, situated forward of the longitudinal midpoint of the kayak and defining a station for a paddler to use the kayak, the kayak having a wetted area defined by a waterline extending from a point distant from the bow approximately equal to one-tenth LOA of the kayak, to a point distant from the bow in a range of approximately two-thirds to three-quarters of the LOA of the kayak, so that the kayak burden is amid the wetted area of the hull whereby the kayak is characterized by high maneuverability by reason of the rear portion of the hull being at or above the water line, the wetted area being situated over the forward two-thirds of the hull, and the cockpit being forward of the kayak midpoint for high mechanical advantage of turning force applied by the paddler as compared to a conventional kayak.

5. A kayak of predetermined length-over-all having a center of buoyancy and comprising a hull and deck, the hull having bottom plate extending from bow to stern with flat transverse lines and a curvilinear longitudinal profile extending in convex curvature downward and aft from the bow reaching a low point adjacent the center of buoyancy, rising gradually toward the stern to a point of transition, and from the point of transition extending in concave curvature upward and aft so as to be out of the water over an aft portion of the hull, and a cockpit fitted through the deck so as to locate the center of mass of kayak occupied by paddler at the center of buoyancy of the kayak.

6. A kayak as defined in claim 5 in which the point of transition is near the midpoint of the kayak.

7. A kayak as defined in claim 5 which has a wetted area in a range of 60% to 75% of the length-over-all of the kayak.

8. A kayak as defined in claim 5 which has a wetted area in a range of 50% to 90% of the length-over-all of the kayak.

9. A kayak as defined in claim 5 which the aft one-quarter to one-third portion of the hull is above the water line of the kayak.

10. A kayak as defined in claim 7 in which the center of balance is amid the wetted area of the kayak.

11. A kayak of predetermined length comprising a hull, deck, cockpit and steering gear, the hull having port and starboard sides, a bow and stern, the hull having a wetted area extending through the forward two-thirds of the length of the kayak, a flat bottom plate extending from the bow in a curvilinear contour gradually rising toward the stern, the bottom plate defining a keel line having a predetermined point of transition, the keel line forming a convex curve from the bow to the point of transition and forming a concave curve from the point of transition to the stern so as to be at or above the wetted area of the hull for the rear one-third of the length of the kayak, the deck affixed to the hull to form an enclosed watertight craft, the cockpit forming an opening through the deck and defining a station for a paddler to use the kayak, the cockpit situated forward of the longitudinal midpoint of the kayak so that the kayak burden is amid the wetted area of the hull whereby the kayak encounters lower water resistance when under way and when maneuvering as compared to a conventional kayak.

12. A kayak as defined in claim 11 in which the convex curve has a radius with a length in a range of 1.4 to 1.8 times the length overall of the kayak.

13. A kayak as defined in claim 11 in which the concave curve has a radius with a length in a range of 2.7 to 3.0 times the length overall of the kayak.

14. A kayak of predetermined length-over-all, longitudinal midpoint, and center of buoyancy, the kayak comprising a hull, deck, cockpit and steering gear, the hull having port and starboard sides, a bow and stern, a bottom plate, the deck affixed to the hull to form an enclosed watertight craft, the cockpit forming an opening through the deck, situated forward of the longitudinal midpoint of the kayak and defining a station for a paddler to use the kayak, the hull being asymmetric in having a hull shape forward of the midpoint defined by a first length-to-girth (l/g) ratio set, and another hull shape aft of the kayak midpoint defined by a second length-to-girth (l/g) ratio set, the kayak first and second sets of length-to-girth (l/g) ratios measured transversely of the hull at equally spaced stations along the kayak from bow to stern, the cockpit situated between stations of the first set that have (i) the lowest l/g ratios of the first set, and that have (ii) l/g ratios lower than the all the l/g ratios of the second set.

15. A kayak as defined in claim 14 in which the center of buoyancy of the kayak is located near the station of the first set having the lowest length-to-girth ratio.

16. A kayak as defined in claim 14 which is marked in eleven equidistant stations 0-10 beginning with station 0 at the bow and having station 5 as the midpoint, with the cockpit located among stations 3, 4 and 5, and the center of buoyancy being at station 4.

17. A kayak as defined in claim 16 in which stations 3, 4, and 5 have an l/g ratio in a range of 3.0 to 3.4.

18. A kayak as defined in claim 17 in which station 4 has an 1/g ratio of 3.08.

19. A kayak as defined in claim 16 in which stations 3, 4, and 5 have an 1/g ratio in a range of 3.6 to 3.8.

20. A kayak as defined in claim 19 in which station 4 has an l/g ratio of 3.6.

21. A kayak as defined in claim 16 in which stations 3, 4, and 5 have an l/g ratio in a range of 2.0 to 2.4.

22. A kayak as defined in claim 21 in which station 4 has an l/g ratio of 2.0.

23. A kayak as defined in claim 14 having a bow section with an l/g ratio in a range of about 4.4 to 29, a midsection with an l/g ratio in a range of about 3 to 3.6, and a stern section with an l/g ratio in a range of about 4.4 to 26.5.

24. A kayak as defined in claim 14 having a bow section with an l/g ratio in a range of about 4.9 to 31.7, a midsection with an l/g ratio in a range of about 3.8 to 4.5, and a stern section with an l/g ratio in a range of about 5.0 to 44.5.

25. A kayak as defined in claim 14 having a bow section with an l/g ratio in a range of about 3.2 to 17.6, a midsection with an l/g ratio in a range of about 2 to 2.4, and a stern section with an l/g ratio in a range of about 2.5 to 19.

26. A kayak as defined in claim 14 wherein the bow and stern are designated as stations 0 and 10 respectively, the kayak having substantially the following intermediate l/g ratios:

| Station | l/g ratio |
|---|---|
| 1 | 7.5 |
| 2 | 4.4 |
| 3 | 3.4 |
| 4 | 3.1 |
| 5 | 3.2 |
| 6 | 3.6 |
| 7 | 4.4 |
| 8 | 6.3 |
| 9 | 11.8. |

27. A kayak as defined in claim 14 wherein the bow and stern are designated as stations 0 and 10 respectively, the kayak having substantially the following intermediate l/g ratios:

| Station | l/g ratio |
|---|---|
| 1 | 8.5 |
| 2 | 5.0 |
| 3 | 3.8 |
| 4 | 3.6 |
| 5 | 3.7 |
| 6 | 4.2 |

-continued

| Station | l/g ratio |
|---|---|
| 7 | 5.1 |
| 8 | 7.2 |
| 9 | 13.5. |

28. A kayak as defined in claim 14 wherein the bow and stern are designated as stations 0 and 10 respectively, the kayak having substantially the following intermediate l/g ratios:

| Station | 1/g ratio |
|---|---|
| 1 | 5.6 |
| 2 | 3.3 |
| 3 | 2.4 |
| 4 | 2.1 |
| 5 | 2.1 |
| 6 | 2.5 |
| 7 | 2.7 |
| 8 | 3.9 |
| 9 | 7.0. |

* * * * *